United States Patent [19]

Gratton et al.

[11] Patent Number: 4,460,888

[45] Date of Patent: Jul. 17, 1984

[54] FUSE

[75] Inventors: Arthur D. Gratton; Terence V. McGhie, both of Cockermouth; Robert C. Whelan, Comberton, all of England; Josephus B. Peeters, Veltem-Beisem, Belgium

[73] Assignee: Dorman Smith Fuses Limited, Cumbria, England

[21] Appl. No.: 428,259

[22] Filed: Sep. 29, 1982

[30] Foreign Application Priority Data

Nov. 27, 1981 [GB] United Kingdom ..... 8135916

[51] Int. Cl.[3] ..... H01H 85/04

[52] U.S. Cl. ..... 337/290; 337/295; 337/297

[58] Field of Search ..... 337/197, 290, 293, 295, 337/297

[56] References Cited

U.S. PATENT DOCUMENTS

| | | | |
|---|---|---|---|
| 3,500,276 | 3/1970 | Hingorany et al. | 337/293 |
| 4,246,563 | 1/1981 | Noerholm | 337/295 X |
| 4,315,235 | 2/1982 | Jacobs | 337/295 |
| 4,376,927 | 3/1983 | McGalliard | 337/297 |

FOREIGN PATENT DOCUMENTS

| | | |
|---|---|---|
| 744200 | 7/1942 | Fed. Rep. of Germany . |
| 1588333 | 4/1967 | Fed. Rep. of Germany . |

*Primary Examiner*—George Harris

*Attorney, Agent, or Firm*—Buell, Blenko, Ziesenheim & Beck

[57] ABSTRACT

A simple and inexpensive low current fuse consists solely of a rigid rod of electrically insulating material and, extending throughout the length of and carried by the rod, at least one longitudinally continuous layer of electrically conductive material. At each of its ends the thickness of the layer is increased to constitute an effective fuse terminal and, at a position intermediate its terminals, is of such a cross-sectional area that it will melt or otherwise change state to interrupt a circuit at a predetermined overload or short circuit condition. The rod may be of tubular form and, in this case, the longitudinally continuous electrically conductive layer may be on the inner surface of the tubular rod and may extend over each end face of the rod and on to the outer surface of the rod at each end to form terminals of appropriate cross-sectional area.

12 Claims, 8 Drawing Figures

FUSE

This invention relates to fuses, especially but not exclusively low current fuses, for use in overload and short-circuit protection of individual components of electrical apparatus or of the electrical apparatus itself.

It is an object of the invention to provide an improved fuse of this kind which is simple in construction and inexpensive to manufacture.

According to the invention, the improved fuse consists solely of a substantially rigid elongate member of electrically insulating material and, extending throughout the length of and carried by the member, at least one longitudinally continuous layer of electrically conductive material, the or each longitudinally extending layer at each of its ends being of such a cross-sectional area as to constitute an effective terminal of the fuse and, at at least one position intermediate its terminals, being of such a cross-sectional area that it will melt or otherwise change state to interrupt a circuit at a predetermined overload or short-circuit condition.

The substantially rigid elongate member of electrically insulating material may be a solid rod or of tubular form and may be of any convenient cross-sectional shape. The elongate member may be made of any organic or inorganic electrically insulating material that will carry a layer or layers of electrically conductive material.

The or each longitudinally continuous layer of electrically conductive material is preferably a conductive film of a metal, metal alloy or a semiconductor, which film may be deposited on a surface of the elongate member by thin film or thick film depositing techniques, chemical deposition, by dipping, by spraying or by electroplating.

Where the elongate member is of tubular form, the or each longitudinally continuous layer of electrically conductive material may be carried on the inside surface of the bore of the member and the layer continued over each end face of the member and on to the outer surface of the member at each end to form terminals of appropriate cross-sectional area. In this case, the bore of the tubular elongate member may be at least partially filled with silica sand or other electrically insulating arc interruption medium, the sand being sealed within the bore by means of end plugs of electrically conductive or electrically insulating material.

As previously indicated, two or more separate longitudinally continuous layers of electrically conductive material may extend throughout the length of and may be integral with the terminals of the fuse and, in this case, preferably a plurality of longitudinally continuous, transversely spaced layers of electrically conductive material extend throughout the length of the fuse, and each such longitudinally continuous layer may vary in its cross-sectional area in order to control the electrical operating characteristics of the fuse. Such layers of electrically conductive material may be formed by masking the surface of the elongate member prior to application of the electrically conductive material or a layer of electrically conductive material may be trimmed to shape after it has been deposited on a surface of the elongate member by machining, by erosion or by laser cutting.

In order to utilise the Metcalf effect, a second layer of electrically conductive material may overlie the surface of the or each first longitudinally continuous layer of electrically conductive material in a localised area of the or each first longitudinally continuous layer, this localised layer being of a material of lower melting point than that of the material of the first layer or layers. Preferably, the second layer of electrically conductive material is in the form of a continuous circumferential or peripheral band which overlies the first longitudinally continuous layer, or a discontinuous circumferential or peripheral band which overlies the first longitudinally continuous layers, at a position intermediate of the terminals of the fuse.

Where the or each longitudinally continuous layer of electrically conductive material is carried on the outside of the elongate member, that part of the layer extending between the terminals may be covered by a layer of electrically insulating material which may be deposited by thin film or thick film techniques, by dipping or by spraying. The insulating material of this layer would be so constituted as to:

(i) prevent any substances from emanating from the fuse during circuit interruption;

(ii) accommodate metal vapour, plasma and ionised gas liberated by melting of the or each longitudinally continuous layer of electrically conductive material and by arcing;

(iii) provide a relatively cool internal surface on which metal vapour may condense, and (iv) combine with metal vapour and products of arcing to form an insulating material which will extinguish the arc and replace the conductive path of the or each longitudinally continuous layer of electrically conductive material by a permanent electrically insulating material; to this end, the insulating material of the overlying electrically insulating layer may contain gaseous inclusions or voids.

Furthermore the material of the elongate body may contribute to or fulfil the functions of (ii), (iii) and (iv).

The electrically insulating material of the overlying electrically insulating layer may be of such a form that, when the fuse has operated, it will change colour or appearance externally to provide an indication of operation of the fuse.

Suitable electrically insulating materials of which the substantially rigid elongate member may be made include ceramics such as porcelain; glass; paper, cloth or fabric-based substantially rigid materials; thermoplastic or thermosetting resins; mica and other natural mineral derived electrically insulating substances; and combinations of these materials, e.g. fibre reinforced plastics materials and resin impregnated paper or fabric. The or each longitudinally continuous electrically conductive layer is preferably of silver but it may also be of aluminium, antimony, beryllium, bismuth, cadmium, chromium, copper, gold, indium, iron, lead, magnesium, nickel, tin, zinc, or any alloy of two or more of these metals.

Where the or each longitudinally continuous electrically conductive layer is of silver, the second layer of electrically conductive material overlying the surface of the or each first longitudinally continuous electrically conductive layer in a localised area of the first layer is preferably of tin but it may be of bismuth, cadmium, indium, lead, zinc, or any alloy of two or more of these metals providing that the metal or alloy employed has a lower melting point than the metal or alloy of the first layer or layers.

The invention is further illustrated by a description, by way of example, of eight forms of the improved fuse with reference to the accompanying diagrammatic drawing, in which.

Figure 1:
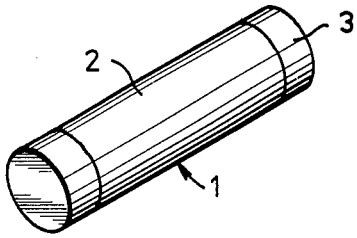
FIGS. 1 and 2 are isometric views of two forms of fuse in which the substantially rigid elongate member is of solid form.
Figure 2:
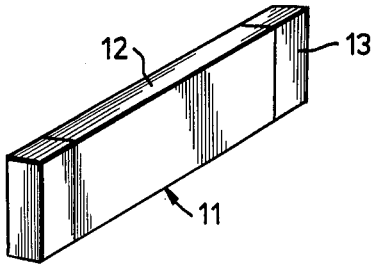

The fuse shown in FIG. 1 consists solely of a substantially rigid rod 1 of porcelain of circular cross-section whose outer circumferential surface carries a longitudinally continuous layer 2 of silver. At each end of the rod 1, the thickness of the longitudinally extending layer 2 is increased to constitute an effective terminal 3 of the fuse. The fuse shown in FIG. 2 consists solely of a substantially rigid rod 11 of porcelain of substantially rectangular cross-section whose outer surface is covered by longitudinally continuous layer 12 of silver which, at each end of the rod, is of increased thickness to constitute an effective terminal 13 of the fuse.

Figure 3:
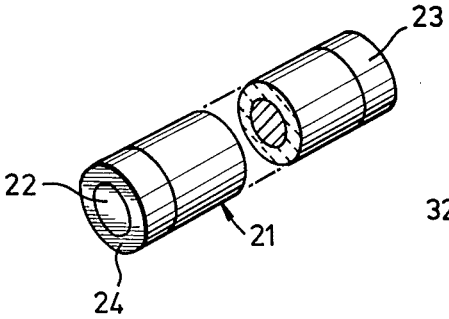
FIGS. 3 and 4 are isometric views, partly in section, of two forms of fuse in which the substantially rigid elongate member is of tubular form.
Figure 4:
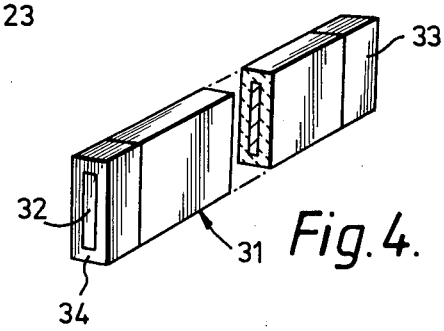

The fuse shown in FIG. 3 consists solely of a substantially rigid tubular member 21 of porcelain of circular cross-section which carries on the inside circumferential surface of the bore of the tubular member a longitudinally continuous layer 22 of silver which continues over each end face 24 of the tubular member and on to the outer surface of the tubular member at each end to form terminals 23 of appropriate cross-sectional area. The fuse shown in FIG. 4 consists solely of a substantially rigid tubular member 31 of porcelain of substantially rectangular cross-section which carries on the inside surface of the bore of the tubular member a longitudinally continuous layer 32 of silver. The longitudinally extending layer 32 at each end of the tubular member 31 continues over each end face 34 of the tubular member and on to the outer surface of the tubular member to form terminals 33 of appropriate cross-sectional area. In each of the fuses shown in FIGS. 3 and 4, the bore of the tubular member may be at least partially filled with silica sand, the sand being sealed within the bore by means of end plugs (not shown) of electrically conductive or electrically insulating material which are force fits in the ends of the bore of the tubular member.

The longitudinally extending layer of silver of each of the fuses shown in FIGS. 1 to 4 is, throughout that part of its length between the fuse terminals, of such a cross-sectional area that it will melt to interrupt a circuit at a predetermined overload or short circuit condition.

Figure 5:
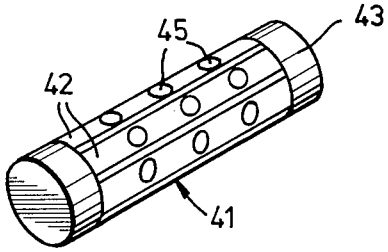
FIGS. 5 to 8 are isometric views of four other forms of fuse in which the substantially rigid elongate member is of solid form.
Figure 6:
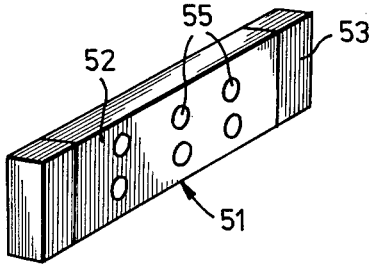

The fuse shown in FIG. 5 consists solely of a substantially rigid rod 41 of porcelain of circular cross-section which carries on its outer surface a plurality of longitudinally continuous, transversely spaced layers 42 of silver which, at each end of the rod, are integral with circumferentially continuous layers of silver constituting effective terminals 43 of the fuse. Each of the longitudinally continuous layers 42 has, at spaced positions along its length, holes 45 where the underlying rod 41 is exposed and where the cross-sectional area of the layer is reduced in order to control the electrical operating characteristics of the fuse. The fuse shown in FIG. 6 consists solely of a substantially rigid rod 51 of porcelain of substantially rectangular cross-section which carries throughout its length a longitudinally continuous layer 52 of silver whose thickness, at each end of the rod, is increased to form an effective terminal 53 of the fuse. The part of the longitudinally continuous layer 52 on each major face of the rod 51 has a plurality of mutually spaced holes 55 defining longitudinally spaced portions of the layer where its cross-sectional area is reduced in order to control the electrical operating characteristics of the fuse.

Figure 7:
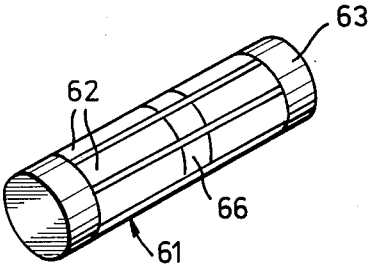

The fuse shown in FIG. 7 consists solely of a substantially rigid rod 61 of porcelain of circular cross-section which carries throughout its length a plurality of longitudinally continuous, transversely spaced layers 62 of silver. At each end of the fuse, the layers 62 are integral with circumferentially continous layers of silver constituting an effective terminal 63 of the fuse. At a position intermediate of the terminals 63 of the fuse, a circumferentially discontinuous band 66 of tin overlies the longitudinally continuous layers 62, the material of the circumferentially continuous band having a melting point lower than that of the material of the longitudinally continuous layers 62. The fuse shown in FIG. 8 consists solely of a substantially rigid rod 71 of porcelain of substantially rectangular cross-section which carries over the whole of its outer surface a longitudinally continuous layer 72 of silver whose thickness at each end of the rod is increased to form an effective terminal 73 of the fuse. At a position intermediate of the terminals 73, a continuous peripheral band 76 of tin overlies the longitudinally continuous layer 72, the material of the band 76 having a melting point which is lower than that of the material of the longitudinally continuous layer 72.

Figure 8:
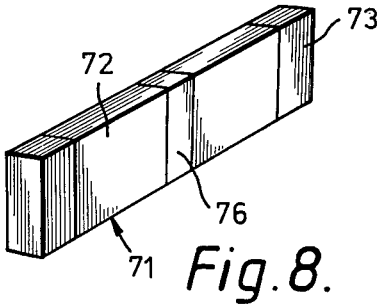

Each of the longitudinally extending layers 62 of silver of the fuse shown in FIG. 7 and the longitudinally extending layer 72 of silver of the fuse shown in FIG. 8 is in at least the region underlying the band 66 or 76, of such a cross-sectional area that it will melt to interrupt a circuit at a predetermined overload or short circuit condition.

In each of the fuses shown in FIGS. 1, 2 and 5 to 8, the electrically conductive layers between the terminals of the fuse may be covered by a layer of electrically insulating material which may be deposited by thin film or thick film techniques, by dipping or by spraying.

In each of the fuses shown in FIGS. 1 to 8, the thickness of the integral terminal portions of the longitudinally continuous layer or layers of electrically conductive materials may be built up by a local overlying coating of an electrically conductive material which is different from but compatible with, and which may be less expensive than, the electrically conductive material of the longitudinally continuous layer or layers. For example, where the integral terminal portions are of silver, the thickness of each may be built up by a local overlying coating of copper.

The fuses of the present invention are especially, but not exclusively, suitable for use as HRC fuses. They are simpler in construction and therefore less expensive than conventional HRC fuses hitherto proposed and used.

What we claim as our invention is:

1. A fuse consisting solely of a substantially rigid elongate member of electrically insulating material and, extending throughout the length of and carried by the member, at least one longitudinally continuous layer of electrically conductive material, the longitudinally extending layer at each of its ends being of such a cross-sectional area as to constitute an effective terminal of the fuse and, at at least one position intermediate its terminals, being of such a cross-sectional area that it will change state to interrupt a circuit at a predetermined fault condition.

2. A fuse consisting solely of a substantially rigid elongate tubular member of electrically insulating material and, extending throughout the length of and carried on the inside surface of the bore of the tubular member, at least one longitudinally continuous layer of electrically conductive material, the longitudinally extending layer at each of its ends continuing over the end face of the member and on to the outer surface of the tubular member to form an effective terminal of the fuse of appropriate cross-sectional area and, at at least one position on the inside surface of the bore of the tubular member intermediate the terminals, being of such a cross-sectional area that it will change state to interrupt a circuit at a predetermined fault condition.

3. A fuse as claimed in claim 2, wherein the bore of the tubular member is at least partially filled with an electrically insulating arc interruption medium, the medium being sealed within the bore by means of end plugs.

4. A fuse as claimed in claim 1 or 2, wherein a plurality of separate longitudinally continuous transversely spaced layers of electrically conductive material extend throughout the length of and are integral with the terminals of the fuse, each such longitudinally continuous layer varying in its cross-sectional area in order to control the electrical operating characteristics of the fuse.

5. A fuse as claimed in claim 1, wherein a second layer of electrically conductive material overlies the surface of the first longitudinally continuous layer of electrically conductive material in a localised area of the first longitudinally continuous layer, this localised layer being of a material of lower melting point than that of the material of the first layer.

6. A fuse as claimed in claim 5, wherein the second layer of electrically conductive material is in the form of a continuous peripheral band which overlies the first longitudinally continuous layer, at a position intermediate of the terminals of the fuse.

7. A fuse as claimed in claim 1 in which the longitudinally continuous layer of electrically conductive material is carried on the outer surface of the elongate member, wherein that part of the longitudinally continuous layer of electrically conductive material extending between the terminals is covered by a layer of electrically insulating material.

8. A fuse as claimed in claim 7, wherein the electrically insulating material of the overlying electrically insulating layer is of such a form that, when the fuse has operated, it will change appearance externally to provide an indication of operation of the fuse.

9. A fuse as claimed in claim 1 or 2, wherein the thickness of each of the integral terminal portions of the longitudinally continuous layer of electrically conductive material is built up by a local overlying coating of an electrically conductive material which is different from but compatible with the underlying electrically conductive material of the longitudinally continuous layer.

10. A fuse as claimed in claims 1 or 2, wherein the substantially rigid elongate member is made of an inorganic electrically insulating material.

11. A fuse as claimed in claim 1 or 2, wherein the longitudinally continuous layer of electrically conductive material is a conductive film of a metal or metal alloy.

12. A fuse as claimed in claim 1, wherein a plurality of separate longitudinally continuous transversely spaced layers of electrically conductive material extend throughout the length of, and are integral with the terminals of, the fuse, and wherein a second layer of electrically conductive material in the form of a discontinuous peripheral band overlies localised areas of the first longitudinally continuous layers at a position intermediate of the terminals of the fuse, said overlying localised layers being of the material of lower melting point than that of a material of the first layers.

* * * * *